US006132251A

United States Patent [19]

Onoda

[11] Patent Number: 6,132,251

[45] Date of Patent: Oct. 17, 2000

[54] RESIN-SEALED CONNECTOR

[75] Inventor: Katsuhiko Onoda, Shizuoka, Japan

[73] Assignee: Yazaki Corporation, Tokyo, Japan

[21] Appl. No.: 09/349,944

[22] Filed: Jul. 8, 1999

[30] Foreign Application Priority Data

Jul. 9, 1998 [JP] Japan ..... 10-193904

[51] Int. Cl.[7] ..... H01R 13/40

[52] U.S. Cl. ..... 439/587; 439/936

[58] Field of Search ..... 439/587, 589, 439/936, 199, 201, 521

[56] References Cited

U.S. PATENT DOCUMENTS

| | | | |
|---|---|---|---|
| 4,083,902 | 4/1978 | Clyde | 439/936 |
| 4,976,634 | 12/1990 | Green et al. | 439/589 |
| 5,194,021 | 3/1993 | Oba et al. | 439/589 |
| 5,518,415 | 5/1996 | Sano | 439/936 |
| 5,637,007 | 6/1997 | Suzuki et al. | 439/936 |

*Primary Examiner*—T. C. Patel

*Attorney, Agent, or Firm*—Morgan, Lewis & Bockius LLP

[57] ABSTRACT

In a resin-sealed connector, a body portion of a guide plate, provided within a housing, is partially smaller in thickness than a base portion of the guide plate, so that reinforcing ribs are formed on side surfaces of the body portion, and that a step portion is formed at the boundary between the body portion and the base portion, and the step portion serves as a mark indicative of an upper limit of filling of a sealing resin in the housing. The side surfaces of the body portion of the guide plate, including the reinforcing ribs, are discontinuous relative to side surfaces of the base portion over an entire periphery of the guide plate. The step portion, formed at the boundary between the body portion and the base portion and between the reinforcing ribs and the base portion, serves as the mark indicative of the upper limit of filling of the sealing resin.

4 Claims, 5 Drawing Sheets

RESIN-SEALED CONNECTOR

BACKGROUND OF INVENTION

1. Field of the Invention

This invention relates to a resin-sealed connector for connecting an electric equipment, provided in a transmission, to an external control device, and more particularly to a resin-sealed connector in which a step portion is formed at a guide plate to serve as an mark indicative of an upper limit of filling of a sealing resin in a housing.

2. Related Art

One conventional resin-sealed connector is shown in FIGS. 4 to 6, and this connector will now be described with reference to the drawings.

FIG. 4 is a partly cross-sectional, perspective view of the conventional resin-sealed connector. FIG. 5(*a*) is an enlarged view of an important portion of FIG. 4, and FIG. 5(*b*) is a plan view of FIG. 5(*a*). FIG. 6 is a vertical cross-sectional view of the resin-sealed connector.

In FIGS. 4 and 6, reference numeral 100 denotes the conventional resin-sealed connector (female connector). This resin-sealed connector 100 is mounted at an opening portion formed in a transmission casing (not shown), through an O-ring 101, and this connector is used to connect an electric equipment (e.g. an oil temperature sensor or a solenoid valve for operating a solenoid valve), provided in the transmission, to an external control device.

This resin-sealed connector 100 includes a housing 110 bent at right angles, and a hood 111 to be disposed outside of the transmission casing is formed integrally at an upper end of this housing.

A plurality of bus bar-like male terminals 130 are insert molded in the housing 110, and project into the interior of the hood 111. These male terminals 130 are connected respectively to female terminals in a mating connector (male connector) (not shown) fitted into the hood 111.

A guide plate 120 for preventing the prying of the mating connector to be fitted into the hood 111 is provided in a projected manner within the hood 111.

As shown in FIGS. 5(*a*) and 5(*b*), a body portion 121 of the guide plate 120 is partially smaller in thickness than its base portion 122, and with this construction, reinforcing ribs 121*a* are formed on opposites side surfaces of the body portion 121, and also step portions 122*a* are formed at the boundary between the body portion 121 and the base portion 122.

As shown in FIG. 6, a sealing resin 140 is filled in the hood 111 so as to prevent the leakage of oil in the transmission casing which would be caused by an capillary action.

Here, if the amount of the sealing resin 140 filled in the hood 111 is small, the oil leakage prevention effect is lowered. In contrast, if the amount of the sealing resin 140 is large, there is encountered a disadvantage that the mating connector can not be completely fitted into the hood 111 when the sealing resin 140 is solidified Therefore, in the conventional construction, the step portions 122*a*, formed at the guide plate 120, are disposed at such a position as to serve as a mark indicative of an upper limit of the filling of the sealing resin 140, and the sealing resin 140 is supplied up to these step portions 122*a*, and by doing so, an appropriate amount of sealing resin 140 is filled in the hood 111.

In the above conventional resin-sealed connector 100, the opposite side surfaces of the body portion 121 of the guide plate 120, including the reinforcing ribs 121*a*, are partially continuous with the opposite side surfaces of the base portion 122, respectively, as shown in FIGS. 5(*a*) and 5(*b*).

Therefore, because of a surface tension, the sealing resin 140, filled up to the step portions 122*a* serving as the upper limit mark, projects beyond the upper limit at the regions (see circles in FIG. 7) where the body portion 121, including the reinforcing 20 ribs 121*a*, is continuous with the base portion 122, as shown in FIG. 7. This results in a problem that the projected sealing resin 140 interferes with the mating connector, thereby causing the incomplete fitting connection of the connector.

SUMMARY OF INVENTION

This invention has been made in view of the above problems, and an object of the invention is to provide a resin-sealed connector in which the projecting of a sealing resin beyond an upper limit due to a surface tension can be positively prevented, and the incomplete fitting connection to a mating connector can be positively prevented.

The above object has been achieved by a resin-sealed connector of the present invention wherein a body portion of a guide plate, provided within a housing, is smaller in thickness than a base portion of the guide plate, so that a step portion is formed at the boundary between the body portion and the base portion, and the step portion serves as a mark indicative of an upper limit of filling of a sealing resin in the housing; and wherein side surfaces of the body portion of the guide plate are discontinuous relative to side surfaces of the base portion over an entire periphery of the guide plate; and the step portion, formed at the boundary between the body portion and the base portion, serves as the mark indicative of the upper limit of filling of the sealing resin.

The above object has also been achieved by a resin-sealed connector of the present invention wherein a body portion of a guide plate, provided within a housing, is partially smaller in thickness than a base portion of the guide plate, so that reinforcing ribs are formed on side surfaces of the body portion, and that a step portion is formed at the boundary between the body portion and the base portion, and the step portion serves as a mark indicative of an upper limit of filling of a sealing resin in the housing; and wherein the side surfaces of the body portion of the guide plate, including the reinforcing ribs, are discontinuous relative to side surfaces of the base portion over an entire periphery of the guide plate; and the step portion, formed at the boundary between the body portion and the base portion and between the reinforcing ribs and the base portion, serves as the mark indicative of the upper limit of filling of the sealing resin.

In this construction, the side surfaces of the body portion of the guide plate are discontinuous relative to the side surfaces of the base portion over the entire periphery of the guide plate, and with this construction the sealing resin, filled up to the upper limit (i.e., the step portion), will not project beyond the upper is limit under the influence of a surface tension, and therefore the appropriate amount of sealing resin can always be filled accurately.

Therefore, the incomplete fitting connection to a mating connector due to the interference of the sealing resin (projecting beyond the upper limit) with the mating connector is positively prevented.

Preferably, as in the resin-sealed connector of the invention, an auxiliary step portion is formed between the body portion and the base portion of the guide plate in such a manner that side surfaces of the auxiliary step surface are discontinuous relative to side surfaces of the step portion over the entire periphery of the guide plate.

In this construction, the mating connector, fitted in the housing, is isolated from the sealing resin filled up to the upper limit (i.e., the step portion) by the auxiliary step portion.

With this construction, even if the sealing resin is filled inadvertently in an amount larger than the appropriate amount, and projects slightly beyond the upper limit, the projecting sealing resin will not interfere with the mating connector, thereby more positively preventing the incomplete fitting connection to the mating connector.

BRIEF DESCRIPTION OF DRAWINGS

FIG. 5(*b*) is a plan view of FIG. 5(*a*);

DETAILED DESCRIPTION OF PREFERRED EMBODIMENTS

Preferred embodiments of resin-sealed connectors of the present invention will be described below with reference to the drawings.

First, a first embodiment of a resin-sealed connector will be described.

Figure 1A:
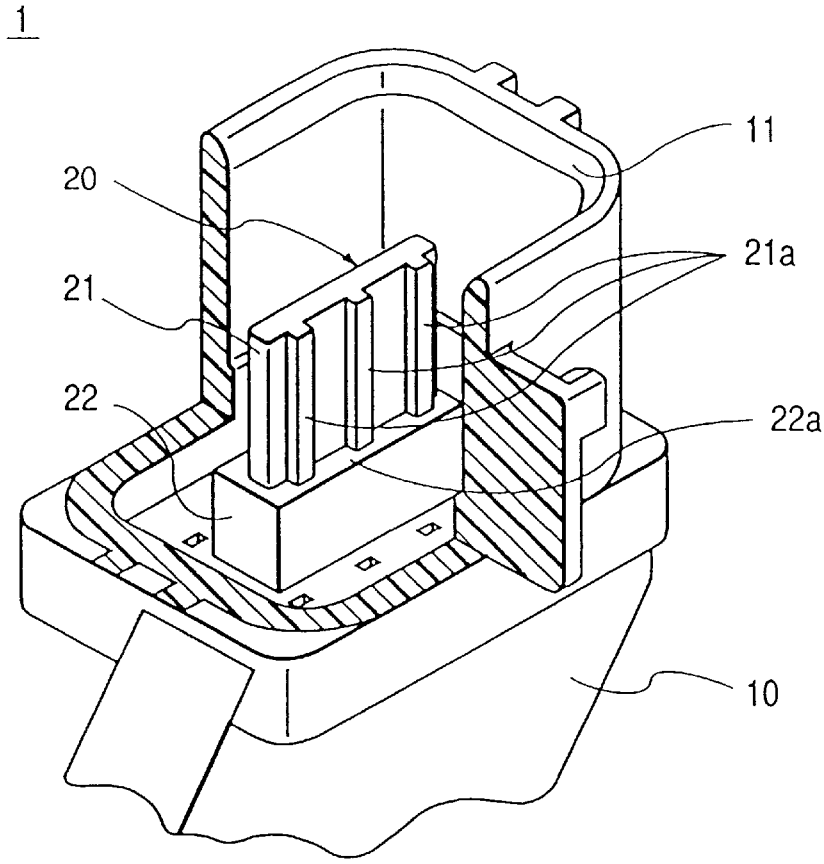
FIG. 1 shows a first embodiment of a resin-sealed connector of the present invention, FIG. 1(*a*) being an enlarged view of an important portion thereof, and FIG. 1(*b*) being a plan view of FIG. 1(*a*)
Figure 1B:
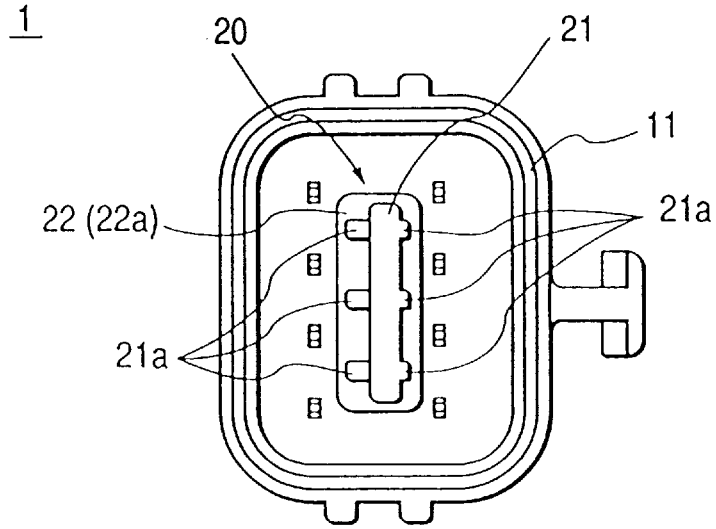

FIG. 1 shows the first embodiment of the resin-sealed connector of the invention, and FIG. 1(*a*) is an enlarged view of an important portion thereof, and FIG. 1(*b*) is a plan view of FIG. 1(*a*).

Figure 2:
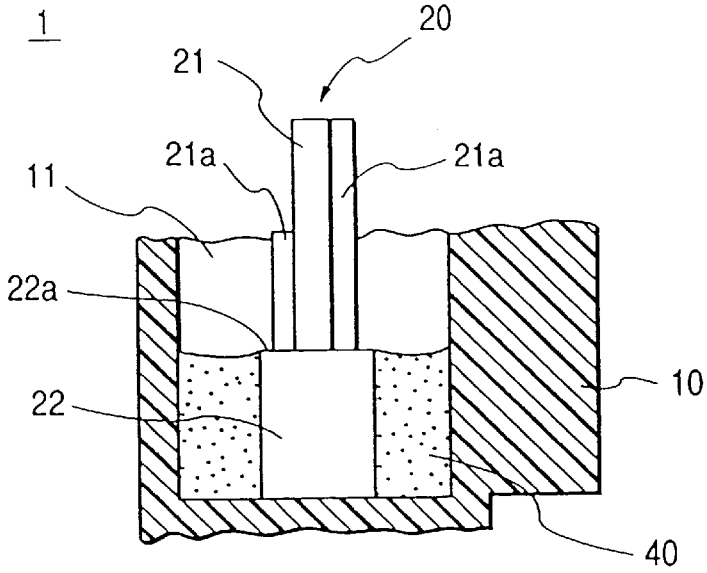
FIG. 2 is a partly cross-sectional view showing a condition in which a sealing resin is filled in the resin-sealed connector.

FIG. 2 is a partly cross-sectional view showing a condition in which a sealing resin is filled in the resin-sealed connector.

In FIGS. 1(*a*) and 1(*b*), reference numeral 1 denotes the resin-sealed connector, and like the conventional connector, this connector includes a housing 10 bent at right angles. A hood 11, into which a mating connector (male connector) (not shown) can be fitted, is formed integrally at an upper end of the housing 10.

A guide plate 20 for preventing the prying of the mating connector to be fitted into the hood 11 is provided in a projected manner within the hood 11.

The guide plate 20 includes a body portion 21, reinforcing ribs 21*a* formed on opposite side surfaces of the body portion 21, and a base portion 22.

In this embodiment, the side surfaces of the body portion 21 of the guide plate 20, including the reinforcing ribs 21*a*, are discontinuous relative to the side surfaces of the base portion 22 over the entire periphery of the guide plate, so that a step portion 22*a* is formed at the boundary between the body portion 21 and the base portion 22 and between the reinforcing ribs 21*a* and the base portion 22.

As shown in FIG. 2, the step portion 22*a* serves as a mark indicative of an upper limit of the filling of the sealing resin 40 in the hood 11, and an appropriate amount of sealing resin 40 is filled in the hood 11 if the sealing resin is filled up to the step portion 22*a*.

Although not shown in the drawings, a plurality of male terminals for connection to female terminals of the mating connector project into the interior of the hood 11 as described above for the conventional construction.

In the resin-sealed connector 1 of this embodiment having the above construction, the side surfaces of the body portion 21 of the guide plate 20 are discontinuous relative to the side surfaces of the base portion 22 over the entire periphery of the guide plate, and with this construction the sealing resin 40, filled up to the upper limit (i.e., the step portion 22*a*), will not project beyond the upper limit under the influence of a surface tension, and therefore the appropriate amount of sealing resin 40 can always be filled accurately.

Therefore, the incomplete fitting connection to the mating connector due to the interference of the sealing resin 40 (projecting beyond the upper limit) with the mating connector is positively prevented.

Next, a second embodiment of a resin-sealed connector of the present invention will be described.

Figure 3:
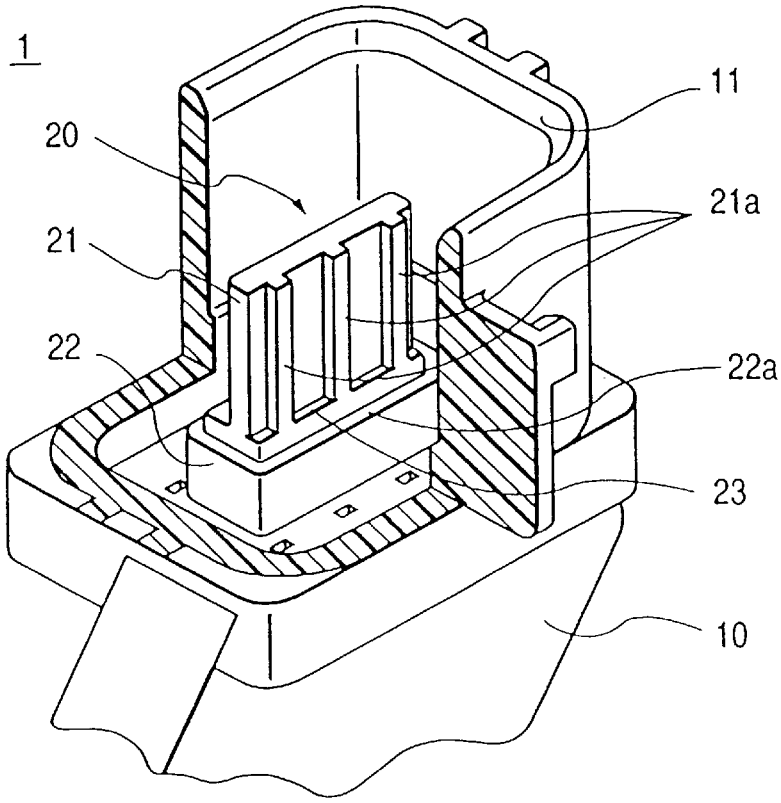
FIG. 3 is an enlarged view of an important portion of a second embodiment of a resin-sealed connector of the invention.
Figure 4:
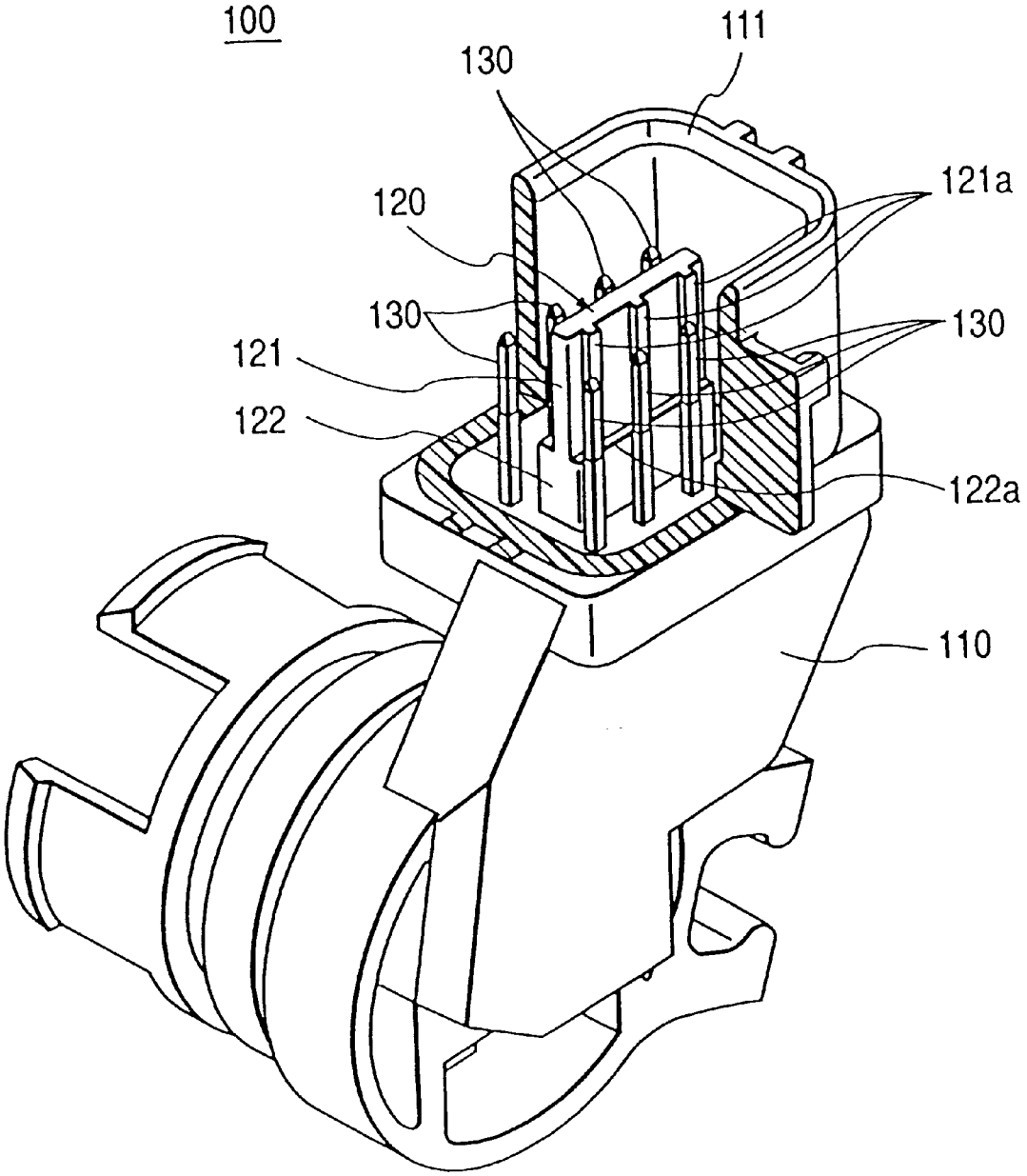
FIG. 4 PRIOR ART
FIG. 4 is a partly cross-sectional, perspective view of a conventional resin-sealed connector.
Figure 5A:
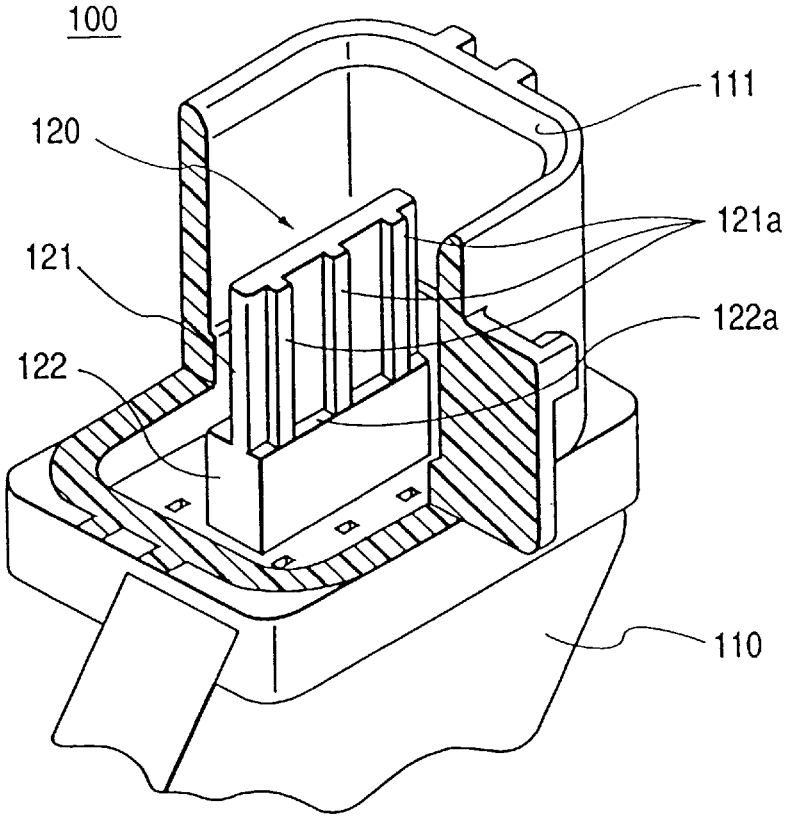
FIG. 5(a) PRIOR ART
FIG. 5(*a*) is an enlarged view of an important portion of FIG. 4.
Figure 5B:
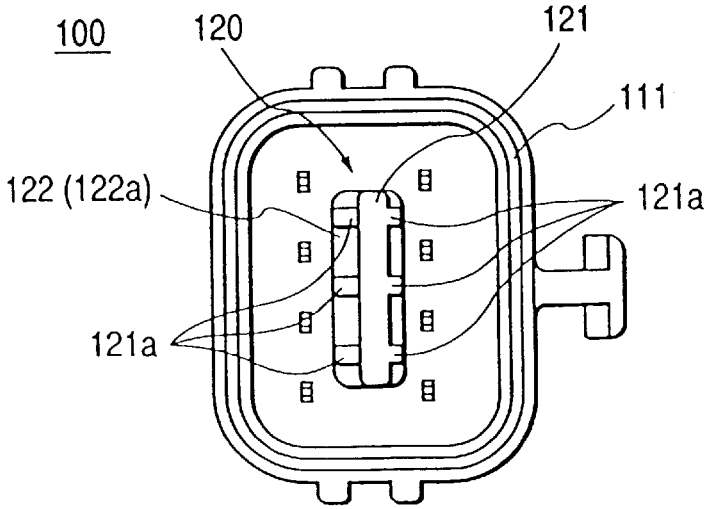
FIG. 5(b) PRIOR ART
Figure 6:
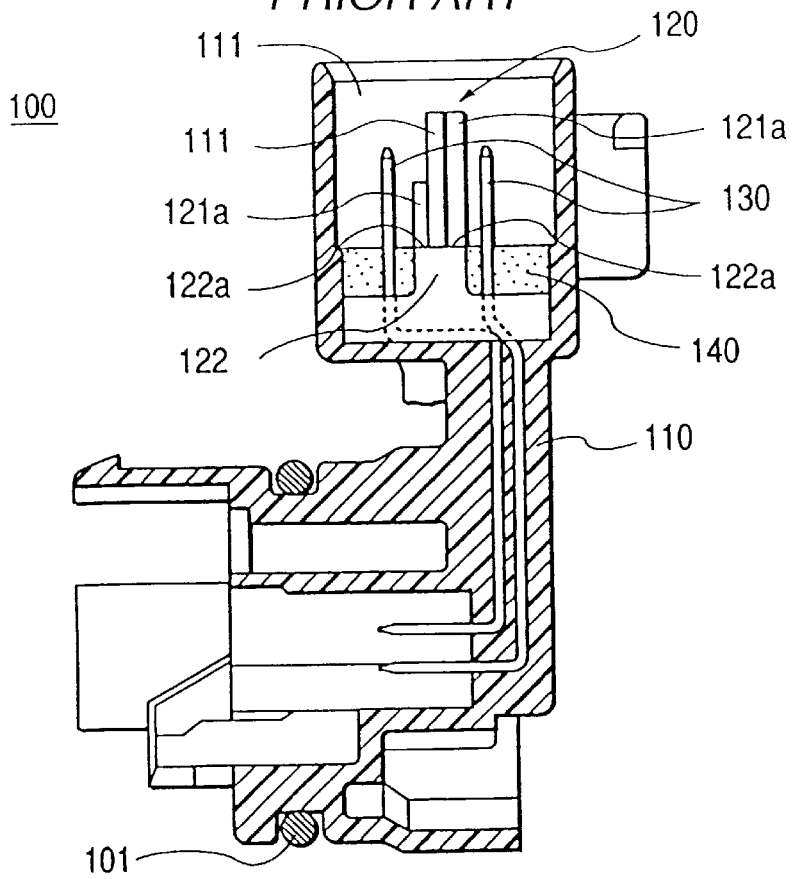
FIG. 6 PRIOR ART
FIG. 6 is a vertical cross-sectional view of the resin-sealed connector.
Figure 7:
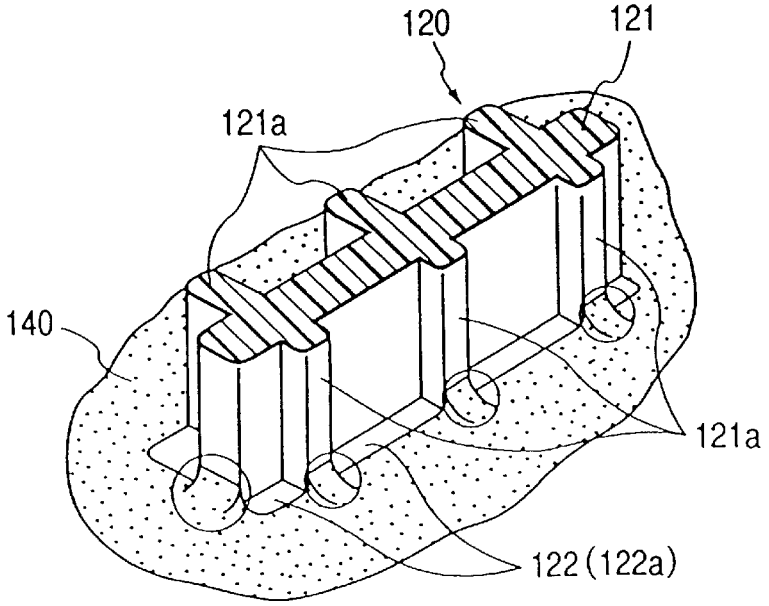
FIG. 7 PRIOR ART
FIG. 7 is a view showing a condition in which a sealing resin, filled in a hood, projects beyond an upper limit under the influence of a surface tension.

FIG. 3 is an enlarged view of an important portion of the second embodiment of the resin-sealed connector of the invention.

In the resin-sealed connector 1 of this embodiment, an auxiliary step portion 23 is integrally formed between a body portion 21 and a base portion 22 of a guide plate 20 in such a manner that side surfaces of the auxiliary step surface 23 are discontinuous relative to side surfaces of a step portion 22*a* over an entire periphery of the guide plate.

The auxiliary step portion 23 serves as a spacer between the mating connector, fitted in a hood 11, and the step portion 22*a*.

In the above construction, the mating connector, fitted in the hood 11, is isolated from a sealing resin 40 (see FIG. 2) filled up to the upper limit (i.e., the step portion 22*a*) by the auxiliary step portion 23.

With this construction, even if the sealing resin 40 is filled inadvertently in an amount larger than the appropriate amount, and projects slightly beyond the upper limit, the projecting sealing resin 40 will not interfere with the mating connector, thereby more positively preventing the incomplete fitting connection to the mating connector.

The present invention is not limited to the resin-sealed connectors of the above embodiments.

For example, in the above embodiments, although the reinforcing ribs 21*a* are formed integrally on the body portion 21 of the guide plate 20, the provision of the reinforcing ribs 21*a* may be omitted, in which case similar effects as described for the above embodiments can be obtained by forming the step portion 22*a* in such a manner that the side surfaces of the body portion 21 are discontinuous relative to the side surfaces of the base portion 22.

As described above, in the resin-sealed connectors of the present invention, the projecting of the sealing resin beyond the upper limit due to a surface tension is positively prevented, and the incomplete fitting connection to the mating connector is positively prevented.

What is claimed is:

1. A resin-sealed connector comprising:

a housing;

a guide plate provided within said housing, said guide plate having a body portion being smaller in thickness than a base portion of said guide plate; and a step portion formed at the boundary between said body portion and said base portion, and said step portion serving as a mark indicative of an upper limit of filling of a sealing resin in said housing, wherein side surfaces of said body portion of said guide plate are discontinuous relative to side surfaces of said base portion over an entire periphery of said guide plate; and said step portion, formed at the boundary between said body portion and said base portion, serves as the mark indicative of the upper limit of filling of the sealing resin.

2. A resin-sealed connector:

a housing;

a guide plate provided within said housing, said guide plate having a body portion being smaller in thickness than a base portion of said guide plate, said body portion having a reinforcing rib on side surface thereof;

a step portion formed at the boundary between said body portion and said base portion, and said step portion serving as a mark indicative of an upper limit of filling of a sealing resin in said housing, wherein the side surfaces of said body portion of said guide plate, including said reinforcing ribs, are discontinuous relative to side surfaces of said base portion over an entire periphery of said guide plate, and said step portion, formed at the boundary between said body portion and said base portion and between said reinforcing ribs and said base portion, serves as the mark indicative of the upper limit of filling of the sealing resin.

3. A resin-sealed connector according to claim 1, further comprising:

an auxiliary step portion is formed between said body portion and said base portion of said guide plate in such a manner that side surfaces of said auxiliary step portion are discontinuous relative to side surfaces of said step portion over the entire periphery of said guide plate.

4. A resin-sealed connector according to claim 2, further comprising:

an auxiliary step portion is formed between said body portion and said base portion of said guide plate in such a manner that side surfaces of said auxiliary step portion are discontinuous relative to side surfaces of said step portion over the entire periphery of said guide plate.

* * * * *